United States Patent [19]

Kestner

[11] 4,002,154

[45] Jan. 11, 1977

[54] VACUUM DELAY AND SHUTOFF VALVE

[75] Inventor: Michael A. Kestner, Richmond, Ind.

[73] Assignee: Dana Corporation, Toledo, Ohio

[22] Filed: Feb. 6, 1975

[21] Appl. No.: 547,386

[52] U.S. Cl. ..... 123/119 A

[51] Int. Cl.[2] ..... F02M 25/00

[58] Field of Search ..... 91/47, 49, 52; 92/94; 251/61.2, 61.3, 61.4, 61.5, 48; 123/119 A

[56] References Cited

UNITED STATES PATENTS

| | | | |
|---|---|---|---|
| 2,154,417 | 4/1939 | Anderson | 123/119 A |
| 3,834,366 | 9/1974 | Kingsbury | 123/119 A |
| 3,885,537 | 5/1975 | Diehl | 123/119 A |
| 3,901,202 | 8/1975 | Hollis | 123/119 A |

*Primary Examiner*—Ronald H. Lazarus

*Attorney, Agent, or Firm*—Richard D. Emch

[57] ABSTRACT

A vacuum operated valve and vacuum delay device is disclosed. The device, which may be connected to a variable vacuum source and employed to serve a vacuum operated switch or valve, includes a bleed orifice for restricting the passage of air therethrough and delaying the effect of vacuum on the switch or valve being served. A spring-loaded diaphragm within the device, operable by the variable vacuum source, is adapted to dissipate vacuum to the valve or switch being served by venting it to atmospheric pressure when the vacuum source reaches a predetermined high level. The vacuum delay and shutoff valve is particularly suitable for serving an exhaust gas recirculation valve of an automobile.

2 Claims, 4 Drawing Figures

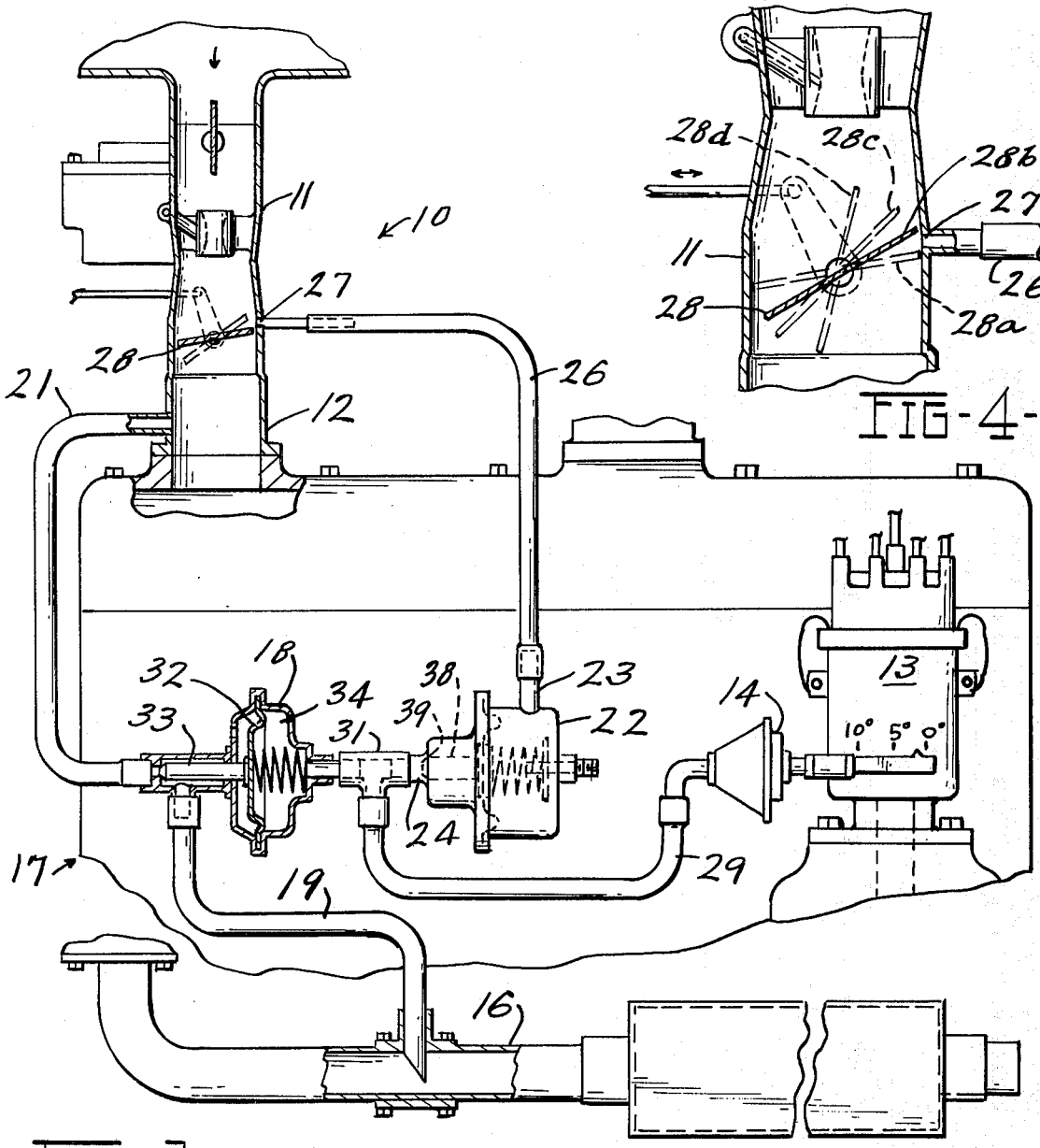
FIG-1-
FIG-4-
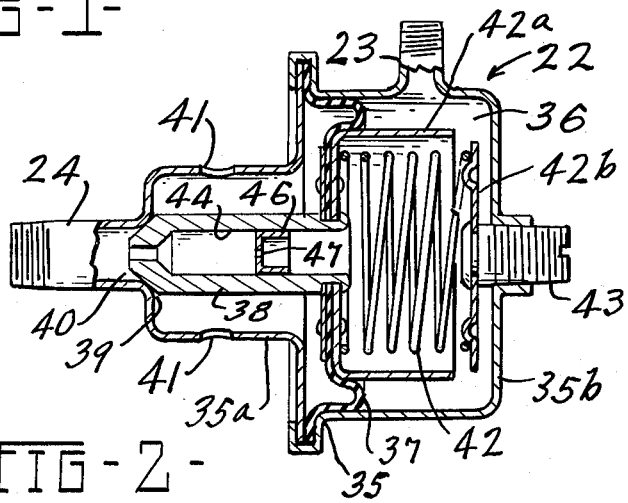
FIG-2-
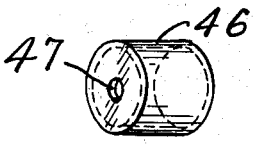
FIG-3-

VACUUM DELAY AND SHUTOFF VALVE

BACKGROUND OF THE INVENTION

The invention relates to vacuum operated valves, and more particularly to a combination vacuum delay and vacuum shutoff apparatus which may be employed in an automotive exhaust gas recirculation system.

Exhaust gas recirculation (EGR) is widely used to control the emission of oxides of nitrogen ($NO_x$) from internal combustion autmotive engines. In such an EGR system, an electronic servo system often is employed to operate the EGR valve, which in turn opens a line from the intake manifold to a source of exhaust gas from the engine. The electronic systems, however, are generally quite costly as either original or added-on equipment.

Another means which has been used to operate the EGR valve has been a vacuum line connected to a ported vacuum source at the carburetor, such as that often used for the vacuum spark advance. When vacuum from the ported source reaches a predetermined level, a diaphragm opens the EGR valve. However, this type EGR actuating system results in EGR during certain engine and vehicle performance conditions wherein EGR is not desirable, and in lack of EGR during certain conditions wherein the recirculation is desirable. For example, when the automobile is in a condition of moderate acceleration from a stop or from a low speed, climbing toward a cruise speed, the ported vacuum source in the carburetor would provide sufficient vacuum to open the EGR valve and permit recirculation. However, exhaust gas recirculation should not be immediately initiated by this condition since not enough air is being drawn through the carburetor and manifold and into the cylinders during this period to maintain smooth engine operation. Recirculation should not commence until approximately when the cruise speed is reached, when air flow into the cylinders is adequate and when the engine is under less demanding loading conditions. Similarly, when the vehicle is at a sustained low speed cruise with the throttle opened only a small amount or when the vehicle is decelerating from a high speed and the throttle is only slightly open, exhaust gas recirculation takes place. Again, EGR is undesirable under these conditions because there is very little air flow through the carburetor and a relatively high vacuum exists in the intake manifold, causing a large EGR flow. The relatively inert exhaust gas thus tends to fill the firing cylinders and when an acceleration is called for there may occur a significant hesitation or engine roughness.

SUMMARY OF THE INVENTION

The present invention provides a vacuum delay and shutoff valve having a vacuum input and a vacuum output. When the vacuum input is connected to a variable source of vacuum and the output is connected to a closed chamber, the device produces a delayed vacuum effect in the closed chamber due to the operation of a bleed orifice. When vacuum from the vacuum source exceeds a predetermined level for which the device can be adjusted, a spring-biased diaphragm within the device retracts, opening a valve and venting the connected closed chamber to the atmosphere, dissipating the vacuum condition therein.

The vacuum delay and shutoff valve of the invention is particularly adaptable for use in an exhaust gas recirculation system of an internal combustion engine. The vacuum input of the device is preferably connected to a ported vacuum source in the carburetor such as the vacuum advance port, while the output side of the device is connected to the vacuum side of a vacuum operated EGR valve.

During periods of slow vehicle cruise or of relatively high engine rpm and only slight throttle opening, when vacuum at the ported source is maximum, the diaphragm of the vacuum delay and shutoff valve retracts to open the shutoff valve and vent the EGR valve to atmospheric pressure, thus closing the EGR valve and stopping exhaust gas recirculation. The delay feature of the device acts to delay opening of the EGR valve when the vehicle is gradually accelerating from a low speed, until the engine has more closely approached cruising speed. This helps eliminate EGR during periods of low air flow through the carburetor, when EGR would be undesirable, as discussed above. The delay feature of the device also works in reverse, such as when a moderate cruising speed has been maintained and the throttle is suddenly fully opened. In this case, vacuum at the ported source will drop to near zero, but vacuum within the EGR valve chamber will not be immediately dissipated. Instead, it will be dissipated slowly by the bleeding of air into the chamber through the orifice of the delay and shutoff valve. Thus EGR will continue during several seconds of rapid acceleration, when engine loading conditions are greatest, $NO_x$ production from the engine is heaviest, and some EGR is desirable. As the rapid acceleration and high engine loading continue, however, the EGR valve closes, since a large amount of EGR would be detrimental to smooth engine operation.

The vacuum delay and shutoff valve of the invention provides a relatively simple, low cost means for regulating the actuation of exhaust gas recirclation in an internal combustion engine.

DESCRIPTON OF THE DRAWINGS

FIG. 1 is a diagrammatic view showing portions of an internal combustion engine having an exhaust gas recirculation system incorporating a vacuum delay and shutoff valve according to the present invention;

FIG. 2 is a sectional view of the vacuum delay and shutoff valve;

FIG. 3 is a perspective view of an element of the vacuum delay and shutoff valve; and FIG. 4 is an enlarged sectional view of a carburetor shown in FIG. 1 including a ported vacuum source connected to the vacuum delay and shutoff valve.

DESCRIPTION OF THE PREFERRED EMBODIMENT

In the drawings, FIG. 1 shows a portion 10 of an internal combustion engine, including a carburetor 11 connected to an intake manifold 12, a distributor 13 including a vacuum operated spark advance 14, an exhaust conduit 16, and an exhaust gas recirculation system generally indicated by the reference number 17. Included within the exhaust gas recirculation (EGR) system are a vacuum operated EGR valve 18 for regulating the flow of exhaust gases from the exhaust conduit 16 through lines 19 and 21 to the intake manifold 12, and a vacuum delay and shutoff valve 22 according to the invention. The apparatus 22 is also vacuum operated, having a vacuum input 23 and a vacuum output 24. The input 23 of the apparatus is connected by a line 26 to a ported vacuum source 27 on the carburetor 11, where a vacuum spark advance line is oridinarily connected on many automotive engines. As seen in FIGS. 1 and 4, the ported vacuum source 27 is positioned adjacent the throttle 28 of the carburetor 11 so that vacuum at the ported source 27 is greatest when the throttle plate 28 is opened to a low setting and is near zero when the throttle plate 28 is either wide open or in the closed position. Instead of being connected directly to the ported vacuum source 27, the vacuum spark advance 14 may be connected through a line 29 to the output side 24 of the vacuum delay and shutoff valve 22 by a suitable T or Y-connection 31 by which the EGR valve 18 is also connected to the device 22.

As indicated in FIG. 1, the EGR valve 18 is spring-biased toward a normally closed position whereby exhaust gases are not allowed to enter the intake manifold 12. A vacuum sensitive diaphragm 32 retracts a valve stem 33 to open the EGR valve when vacuum in a chamber 34 behind the diaphragm 32 and connected to the T 31 exceeds a predetermined level.

The vacuum delay and shutoff valve 22 is shown in greater detail in FIG. 2. It includes a casing 35 which may comprise two crimped-together portions 35*a* and 35*b*. Like the EGR valve, the device 22 includes a vacuum chamber 36 behind a diaphragm 37 which operates to retract a valve stem 38. The valve stem 38 cooperates with a valve seat 39 to define a valve 40 which, when opened by retraction of the stem 38, acts to vent the output side 24 of the device 22 to the atmosphere through vent openings 41. A compression spring 42 biases the diaphragm 37 and valve stem 38 toward the closed position and a screw member 43 is provided for adjustment of the bias force exerted by the spring 42. The adjustable spring structure includes a cup member 42*a*, and a backplate 42*b* cooperating with the adjustment screw 43. The vacuum delay and shutoff valve 22 also includes a central bore 44 through the valve stem 38, through which vacuum is supplied from the input side 23 to the output side 24. Thus, in normal operation of the device 22 at low vacuum level from the ported carburetor vacuum source 27, vacuum at the input 23 and in the chamber 36 is communicated through the central stem bore 44 to the output side 24 of the device 22. However, the device 22 includes a vacuum delay feature which is provided by a cup member 46 within the bore 44, including a bleed orifice 47. The cup member 46 is also shown in FIG. 3.

In operation of the vacuum delay and shutoff valve 22 within the EGR system 17, vacuum supplied to the input 23 of the device 22 is variable according to the position of the throttle plate 28 within the carburetor 11. In the idle position 28*a* shown in dashed lines in FIG. 4, wherein the throttle is nearly closed, there is no vacuum at the ported source 27. This is the position that the throttle would be in when the vehicle is at rest with the engine idling, or in a decelerating condition following a period of open throttle. When the throttle is in this idle position 28*a*, air flow through the carburetor 11 and the intake manifold 12 into the firing cylinders is extremely low and manifold vacuum is high. Exhaust gas recirculation is not desirable in this condition for several reasons. Very little fuel is being burned and thus emissions are at a low level. More importantly, if EGR would take place under this condition, the high vacuum present in the intake manifold would cause a large EGR flow and the relatively inert exhaust gas would tend to fill the firing cylinders. If an acceleration were called for following this condition, the engine would be likely to hesitate or run roughly. As would normally be the case, vacuum spark advance is zero with the throttle in the idle position 28*a*.

When the throttle plate 28 is in the slightly opened position 28*b* shown in solid lines in FIG. 4, maximum vacuum exists at the ported vacuum source 27. The higher the engine rpm in this throttle position 28*b*, the higher the vacuum. The shutoff feature of the vacuum delay and shutoff valve 22 can be adjusted so that at any engine speed over a very low rpm, vacuum from the ported source 27 will be sufficient to retract the diaphragm 37 of the shutoff and open the valve 40, venting the EGR valve 18 to the atmosphere and curtailing exhaust gas recirculation. The reason for the shutoff of EGR with the throttle in the position 28*b* is, again, that very little air is flowing through the carburetor 11 and a high vacuum exists in the intake manifold 12. Thus, when the automobile incorporating the system 17 is in a decelerating condition with the throttle cracked open to the position 28*b* shown in FIG. 4, the EGR valve 18 will be maintained closed. Also, when the vehicle is cruising at a low speed such as about 20–30 mph, the throttle may be in the position 28*b* and again their would be no EGR. Since the vacuum spark advance 14 is connected to the outlet side 24 of the device 22, there would be no spark advance under these sustained conditions. Although in an engine having the vacuum advance 14 connected directly to the ported vacuum source 27, this throttle position 28*b* would produce maximum spark advance, the lack of spark advance under this condition is actually beneficial toward reduction of emissions. It is recognized that $NO_x$ production is reduced by retardation of spark, even though power and economy are somewhat compromised under certain conditions such as the slow cruise described above. Of course, in the decelerating condition discussed above with the throttle in the position 28*b*, spark advance is not needed and thus nothing is compromised.

At higher sustained driving speeds, such as about 40–70 mph, the throttle 28 of the automobile might be in a position 28*c* shown in dashed lines in FIG. 4. In this sustained position, vacuum at the ported vacuum source 27 will be sufficient to open and maintain open the EGR valve 18 but not sufficient to activate the shutoff feature of the device 22. Vacuum from the ported source is communicated to the vacuum chamber 34 of the EGR valve 18 through the bleed orifice 47 and the central bore 44 of the valve stem 38 (see FIG. 2). Similarly, vacuum is supplied to the vacuum spark advance 14 via the output side 24 of the vacuum delay and shutoff valve 22. In this condition, exhaust gas recirculation is most desirable, since there is sufficient air flow through the carburetor 11 and into the engine and vacuum in the intake manifold 12 is not high enough to draw an excessively large flow of exhaust therethrough. Spark advance remains at the level it would assume were the vacuum advance 14 connected directly to the ported vacuum source 27.

FIG. 4 also indicates in dashed lines a full open position 28*d* of the throttle plate 28. In the rapid acceleration condition associated with this wide open throttle position, there is very little vacuum at the ported vacuum source 27 and if the condition is maintained for a period, the EGR valve 18 will be closed under the influence of the biasing spring 42, eliminating any exhaust from entering into the intake manifold. Spark advance will also drop to near zero. The reason for the shutoff of EGR under this condition is that EGR can reduce power output and cause the engine to run roughly under the demanding conditions associated with rapid acceleration. However, during rapid acceleration when the engine load is highest, $NO_x$ production from the engine is greatest, and therefore any EGR that can be introduced during this condition is helpful toward reduction of emissions. For this reason, the delay feature of the vacuum delay and shutoff valve 22 effects a compromise by providing a limited EGR flow during the period of rapid acceleration as will be seen below.

The delay feature of the vacuum delay and shutoff valve 22 comes into play in several situations involving changes in setting of the throttle plate 28. For example, when the throttle 28 is opened from the cruise position 28*b* to the full open position 28*d* of rapid acceleration described above, the delay orifice 47 within the valve stem 38 of the delay and shutoff device 22 (see FIG. 2) acts to prevent the immediate closure of the EGR valve 18, even though pressure at the ported vacuum source 27 and at the device input 23 has dropped to near zero. The delay occurs because a short period of time is required for air to bleed through the orifice 47 into the vacuum-charged chamber 34 of the EGR valve 18 to allow the spring-biased valve stem 33 to return to the closed position. The delay period is of course determined by the pressure differential and by the size of the orifice 47, which may be sized to create a delay in this situation of anywhere from about one second to six seconds. As discussed above, the operation of the delay feature between cruise and rapid acceleration settings of the throttle plate 28 provides for continued EGR for $NO_x$ reduction during a portion of the rapid acceleration period. EGR flow is low during the short period it remains open, due to the low vacuum existing in the carburetor. The spark also remains advanced during the delay period, aiding in more complete combustion. Of course in the unlikely event that the throttle plate 28 is initially opened from an idle position 28*a* to the full open position 28*d*, no EGR will occur as long as the rapid acceleration continues.

When the throttle is moved to the position 28*c* shown in FIG. 4 from a lower setting, as during gradual acceleration from a low speed or upon the reaching of a cruising speed, vacuum would be sufficient to open the EGR valve. However, the delay feature of the vacuum delay and shutoff valve 22 again comes into play, preventing the immediate opening of the EGR valve. This delay is desirable because exhaust gas should not be recirculated during the time the throttle plate 28 is in an only slightly opened position, for reasons discussed above. Thus, as the throttle plate is being opened and passes through the position 28*b* shown in FIG. 4, the EGR valve will not open immediately but will tend to open closer to the time when the cruise speed is reached. The shutoff feature of the device 22 does not function as the throttle plate 28 is moved open through the position 28*c* during acceleration of the vehicle from rest, since engine rpm at this instant is not high enough to create sufficient vacuum to activate the shutoff feature. The spring adjustment screw 43 is preferably positioned to regulate performance of the shutoff feature in this preferred manner. During this period of gradual acceleration toward cruise, the spark is gradually advanced due to the effect of the bleed orifice 47.

If the throttle is suddenly dropped from the cruise position 28*c* to the fully closed position 28*a*, quickly passing through the position 28*d* so that the shutoff feature is not activated, vacuum in the line 26 and the chamber 36 of the device 22 will immediately drop to near zero, but the delay feature of the device 22 will prevent immediate closure of the EGR valve 18, permitting exhaust gas recirculation for several seconds. It is actually desirable to curtail EGR as soon as possible in this situation, for reasons given above in connection with the idle throttle setting 28*a*. However, the connection of the vacuum spark advance 14 to the output side of the vacuum delay and shutoff valve 22 acts to compensate for the briefly continued EGR. The spark remains advanced as long as the EGR valve remains open, aiding in more complete combustion. Of course if the throttle is brought to the closed position 28*a* more gradually, a high vacuum will be communicated to the device 22 as the throttle plate passes through the position 28*b*, so that the shutoff feature of the device 22 will be activated by retraction of the diaphragm 37 and opening of the valve 40 to immediately close the EGR valve.

The above described preferred embodiment provides a simple and economical apparatus for controlling the operation of an EGR valve in response to varying engine conditions. Various other embodiments and alterations to this preferred embodiment will be apparent to those skilled in the art and may be made without departing from the spirit and scope of the following claims.

I claim:

1. An exhaust gas recirculation system for an internal combustion engine comprising an EGR valve for admitting, upon opening, a portion of exhaust gases to an intake manifold, a slave vacuum responsive means for opening said EGR valve upon introduction of a vacuum upon said slave means, means for establishing an open circuit between said slave means and a carburetor vacuum source, a master vacuum responsive means within said circuit and in continuous open communication between said slave means and the vacuum source, said master means actuating said slave means, said master comprising a vacuum sensing chamber open to the vacuum source and an atmospheric release chamber open to atmosphere, valve means for opening said atmospheric release chamber into communication with said slave means and said vacuum chamber upon imposition of a first greater vacuum upon said vacuum chamber and for closing said atmospheric release chamber to establish communication between said slave means and the vacuum source upon imposition of a second, lesser vacuum upon said vacuum chamber, whereby said EGR valve remains closed when said first greater vacuum condition is imposed at the vacuum source, and whereby said EGR valve is opened when said lesser vacuum condition is imposed at the vacuum source.

2. The exhaust gas recirculation system of claim 1 wherein said master vacuum responsive means further comprises means within said valve means for delaying introduction of atmosphere from said release chamber into said vacuum chamber when said atmospheric release chamber is open in response to said first greater vacuum.

* * * * *